US006052855A

United States Patent [19]

Terui

[11] Patent Number: 6,052,855

[45] Date of Patent: Apr. 25, 2000

[54] LIQUID FLOW WORKPIECE CASSETTE WASHING APPARATUS

[75] Inventor: Yoshinobu Terui, Ayase, Japan

[73] Assignee: Speedfam Clean Systems Co., Ltd., Ayase, Japan

[21] Appl. No.: 09/170,277

[22] Filed: Oct. 13, 1998

[30] Foreign Application Priority Data

Oct. 30, 1997 [JP] Japan ..... 9-314427
Jul. 23, 1998 [JP] Japan ..... 10-207924

[51] Int. Cl.[7] ..... A47L 15/00

[52] U.S. Cl. ..... 15/77; 15/88.1; 15/88.3

[58] Field of Search ..... 15/88.1, 88.2, 15/88.3, 61, 64, 77, 97.1, 102, 21.1

[56] References Cited

U.S. PATENT DOCUMENTS 1,924,432 8/1933 Griffith ..... 15/88.2
2,023,163 12/1935 Burr ..... 15/88.3
3,561,391 2/1971 Locati ..... 15/88.3
4,774,737 10/1988 Hanson ..... 15/21.1
5,890,251 4/1999 Terui ..... 15/88.2
5,893,381 4/1999 Terui ..... 15/88.2

*Primary Examiner*—Robert J. Warden, Sr.
*Assistant Examiner*—Kaj K. Olsen
*Attorney, Agent, or Firm*—Oblon, Spivak, McClelland, Maier & Neustadt, P.C.

[57] ABSTRACT

A plurality of washing sections 6, 7, and 8 for individually washing different portions of a cassette body 111 in a washing liquid 3 using washing brushes 10, 14, and 20, respectively, are sequentially formed in a groove-shaped washing vessel 2 through which the washing liquid 3 flows continuously. A plurality of transfer means 26, 27, and 28 for chucking the cassette body 111 being washed to bring it into contact with the washing brushes 10, 14, and 20, respectively, and for transferring the cassette body 111 that has been washed to the washing section upstream are provided so as to correspond to the washing sections 6, 7, and 8, respectively.

10 Claims, 12 Drawing Sheets

LIQUID FLOW WORKPIECE CASSETTE WASHING APPARATUS

FIELD OF THE INVENTION

The present invention relates to a liquid flow workpiece cassette washing apparatus for automatically washing, in a flow of a washing liquid, a cassette accommodating substantially disc-shaped workpieces such as magnetic disc circuit boards or semiconductor wafers.

PRIOR ART

During polishing or washing of workpieces such as magnetic disc circuit boards or semiconductor wafers, or in similar processes, a cassette 110 such as that shown in FIGS. 13 and 14 is used to transfer the workpieces. The cassette 110 comprises a cassette body 111 shaped like a rectangular frame in which the top and bottom surfaces and longitudinal sides are partly open and which has a narrower portion 111*a* at its bottom; and a top cover 112 covering the top surface and both sides of the cassette body 111; and a bottom cover 113 covering the bottom surface.

The cassette body 111 has a large number of vertical grooves 115 in its interior so that a plurality of workpieces 116 are vertically accommodated in the vertical grooves 115 through the open top surface and stored therein. In addition, as shown in FIG. 15A, the top cover 112 comprises a roof portion 117 covering the top surface of the cassette body 111, and a pair of side plate portions 118, 118 extending downward from the respective ends of the roof portion 117 cover the opening in the side of the cassette body 111. A plurality of grooves 117*a* in which the upper ends of the workpieces 116 are fitted and abutted are formed in the inner surface of the roof portion 117. Furthermore, the bottom cover 113 is shaped like a shallow dish as illustrated in FIG. 15B.

With repeated use of the cassette body 111 and top cover 112 and bottom cover 113 constituting the cassette 110, the inner and outer surfaces of the body are likely to become dirty and thus to contaminate the accommodated workpieces 116, so these members must be periodically washed. The cassette body 111, the top cover 112, and the bottom cover 113, however, all have complex three-dimensional shapes, making it very difficult to wash their inner and outer surfaces and grooves completely.

Japanese Patent No. 2,567,320 is known as an apparatus for washing such cassettes (carriers) . As shown in FIG. 16, this apparatus comprises an overflow washing vessel 120 in which a washing liquid 121 supplied from the bottom of the vessel partly flows out from the upper end of the wall; and two rotating brushes 122, 122 provided inside the vessel to rotate around a horizontal shaft, wherein a rotating table 124 rotates a carrier 123 by 90° at a time while the rotating brushes 122, 122 wash the inner and outer sides of the wafer carrier 123 one side at a time.

Since, however, this conventional washing apparatus is of an overflow type, the washing liquid may cause a circular flow inside the washing vessel 120, thereby causing most of the dirt released from the carrier to enter the circulating flow and course through the vessel. In such cases, the dirt fails to be ejected appropriately and re-adheres to the rotating brushes 122, 122, reducing subsequent washing effectiveness.

In addition, the carrier 123 is rotated in one position by 90° to allow the two rotating brushes 122, 122 to wash all the inner and outer surfaces of the carrier one surface at a time, and thus a large amount of time is required to wash one carrier; throughput is relatively low.

Furthermore, since during washing, rotating brushes of large diameter move in a vertical direction, high resistance from the washing liquid acts on the rotating brushes to cause their rotational speed to vary or their constituent fibers to vibrate vertically, thereby reducing washing efficiency and/or disturbing the flow of washing liquid to prevent dirt from being ejected smoothly.

DISCLOSURE OF THE INVENTION

It is a main technical object of this invention to provide a washing apparatus for washing a cassette that accomodates disc-shaped workpieces, wherein dirt released from the cassette is prevented from re-adhering to the cassette or the apparatus' rotating brushes in order to improve washing effectiveness, throughput, and thus production efficiency.

It is a dependent technical object of this invention to provide the above apparatus, that eliminates the above disadvantages resulting from the vertical movement of large-diameter rotating brushes in order to enable the cassette to be washed efficiently.

To achieve the above object, the washing apparatus according to this invention is characterized by a single groove-shaped washing vessel in which a washing liquid uniformly, continuously, and horizontally flows from one direction to the other, and by the washing vessel, which has formed therein a plurality of washing sections for individually washing different portions of a three-dimensional cassette component in the washing liquid using washing brushes.

This washing apparatus also includes a support means in each washing section for supporting an object to be washed in the washing liquid; a plurality of transfer means in each washing section for individually chucking the object that has been washed and transferring it to the subsequent washing section; a loading means for supplying an unwashed object to the most downstream washing section; and an unloading means for unloading from the upstream-most washing section an object that has been washed, wherein these means all move synchronously.

The present washing apparatus of this configuration can use the plurality of washing sections to synchronously wash multiple portions of an object to be washed in order to wash the object while continuously transferring it at short-term intervals after washing a single portion, thereby achieving a very high washing efficiency and an excellent throughput.

In addition, since the object is washed in washing liquid flowing in a horizontal direction, dirt released from the washed object is carried quickly and smoothly downstream by the flowing washing liquid for ejection, thereby preventing the dirt from re-adhering to the washed object or the rotating brushes. Accordingly, once a washed object is unloaded from the washing vessel, it has been rinsed due to its contact with clean washing liquid.

According to one specific configuration aspect, the washing apparatus includes three washing sections for washing a cassette body. One of the washing sections possesses a single roll-like washing brush that washes the inner surface of the cassette body, another possesses two washing brushes that simultaneously wash the front and rear surfaces of the cassette body, and the third possesses two washing brushes that simultaneously wash the respective lateral sides of the cassette body. The washing brushes are all installed so as to rotate at specified positions in the washing liquid.

In this case, the apparatus preferably has three sets of transfer means for transferring the cassette body to a washing section located on the upstream side, with each of the transfer means also acting as the support means for supporting the cassette body being washed; also, the transfer means located furthest upstream also acts as the unloading means.

In addition, of the three sets of transfer means, the one provided so as to correspond to the washing section that washes the inner, front, and rear surfaces of the cassette body desirably moves up and down during washing to move the cassette body.

Consequently, the cassette body can be washed without moving the rotating brush up and down, thereby preventing any variation in the brush's rotational speed, any decrease in washing efficiency caused by the vertical vibration of the brush's constituent fibers, and any hindrance to washing operations or dirt removal caused by a notable disturbance to the flow of the washing liquid.

According to another specific configuration, the washing apparatus is configured so as to wash the top cover covering the top surface and sides of the cassette body, and has four washing sections. A washing brush for a grooved portion of the inner surface of a roof portion of the top cover that is contacted by workpieces is provided in one of the four washing sections so as to oscillate. A washing brush for washing the portion of the inner surface of the roof portion of the top cover that is non-grooved is provided in another washing section so as to move. Two inner-surface brushes for washing the inner surfaces of the pair of side plate portions of the top cover and two outer-surface brushes for washing the outer surfaces of the side plate portions are each provided in yet another washing section so as to move along the side plate portion at a low speed. A washing brush for washing the outer surface of the roof portion of the top cover is provided in the remaining washing section so as to move along the outer surface of the roof portion.

The washing apparatus can be configured so that a plurality of objects can be simultaneously processed in parallel, by providing a plurality of washing brushes for washing a plurality of objects, which are positioned in parallel in some or all of the plurality of washing sections, and by configuring each support means, each transfer means, the loading means, and the unloading means in such a way that each can hold a plurality of objects.

Furthermore, according to this invention, the washing vessel has one or more supersonic irradiation means for irradiating the washing liquid with supersonic waves.

DETAILED DESCRIPTION

Figure 1:
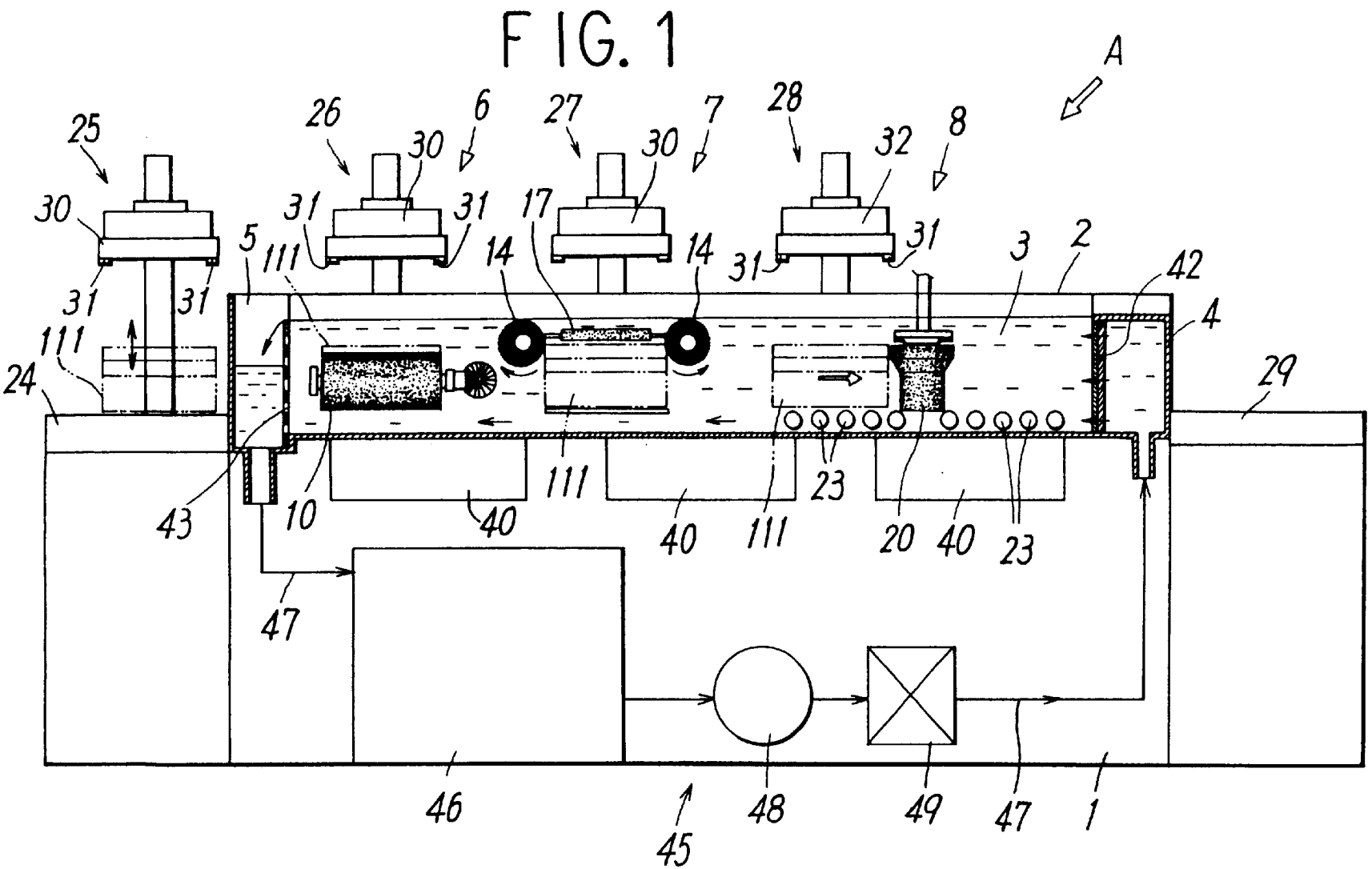
FIG. 1 is a vertical sectional side view showing a first embodiment of a washing apparatus according to this invention.
Figure 2:
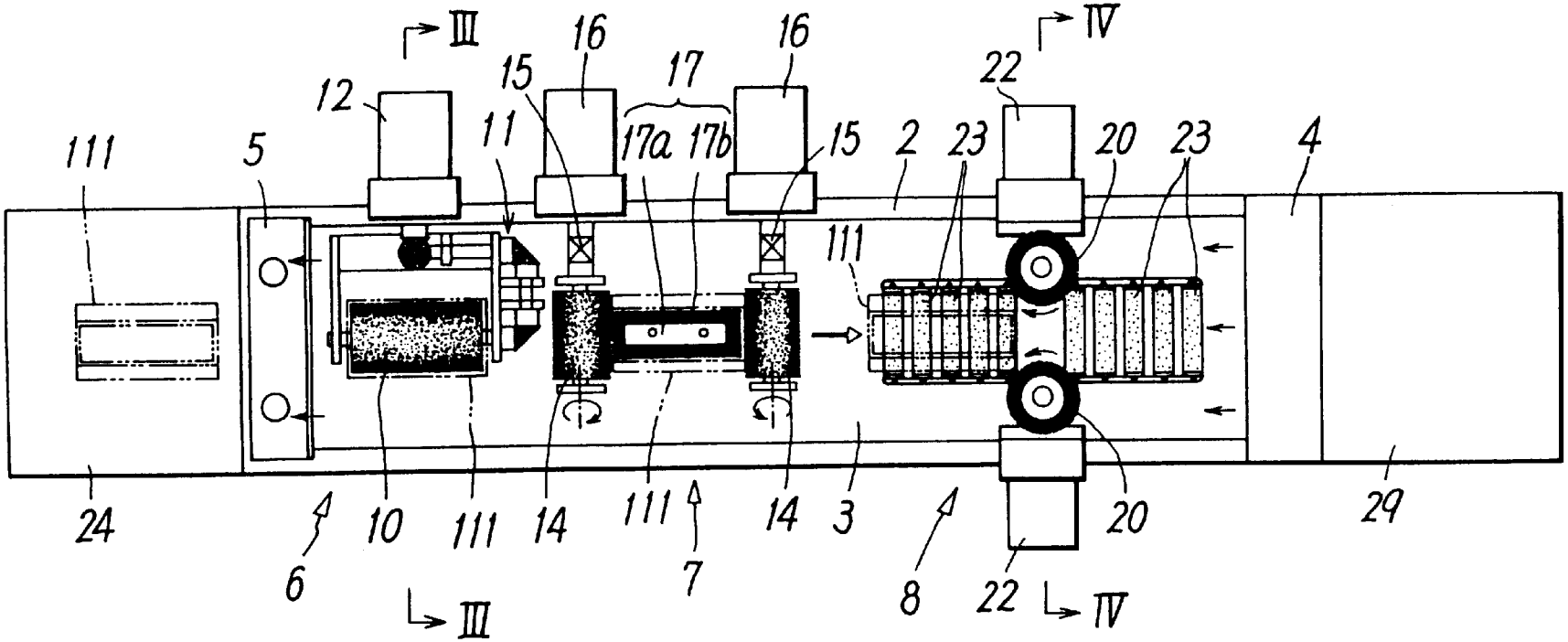
FIG. 2 is a top view of FIG. 1.
Figure 13:
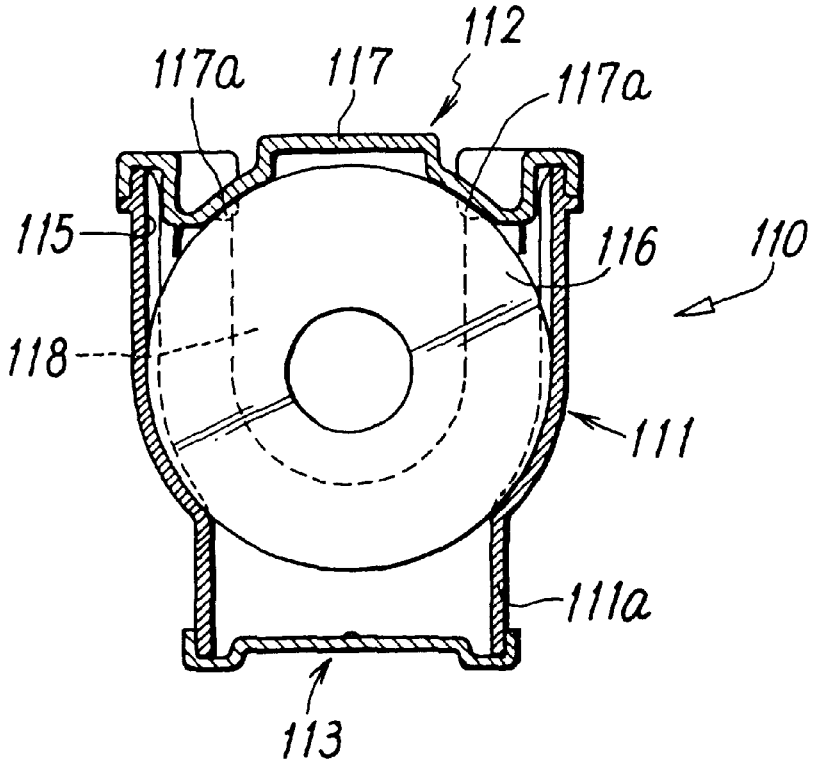
FIG. 13 is a sectional view of a cassette that is an object to be washed.

FIGS. 1 and 2 show a general configuration of a first embodiment of a washing apparatus according to this invention. A washing apparatus A is configured so as to wash a cassette body 111 that is one of the components of a cassette shown in FIG. 13.

Figure 14:
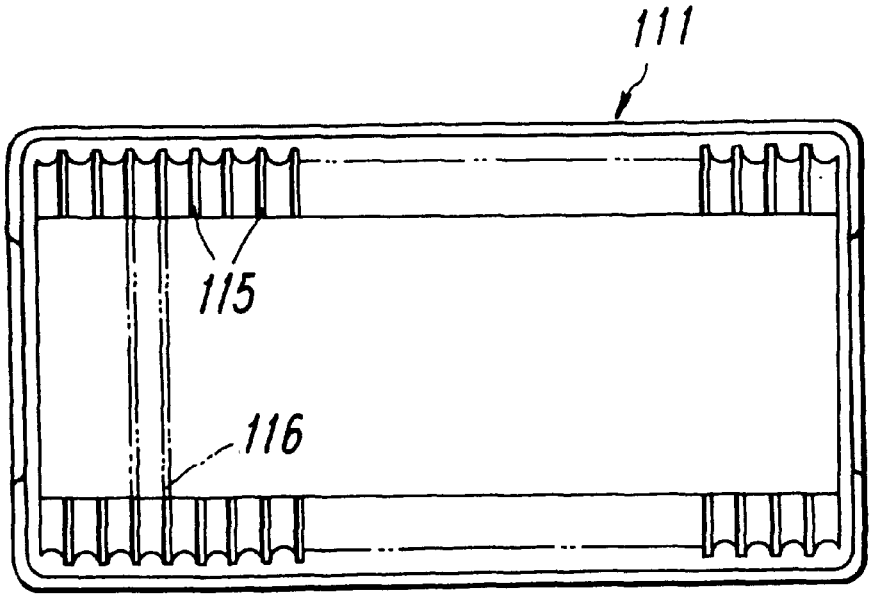
FIG. 14 is a top view of a cassette body.
Figure 15A:
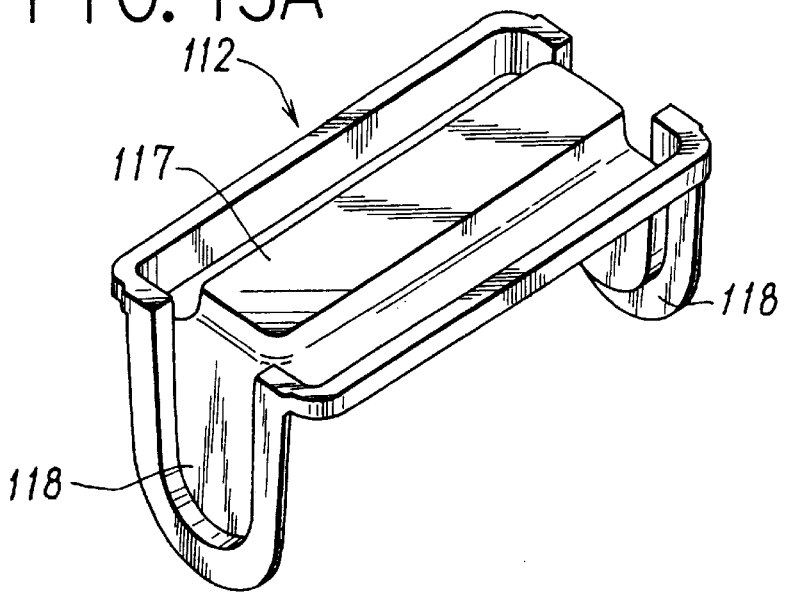
FIG. 15A is a perspective view of the top cover and FIG. 15B is a perspective view of a bottom cover.
Figure 15B:
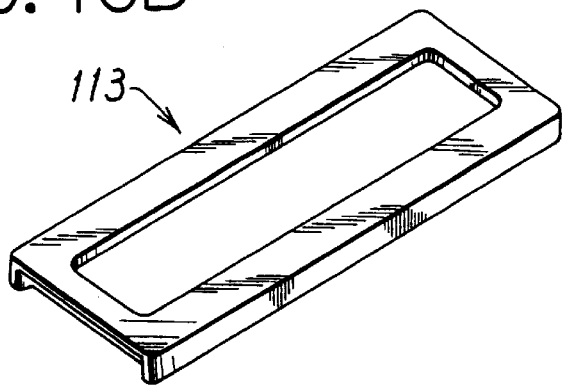
Figure 16:
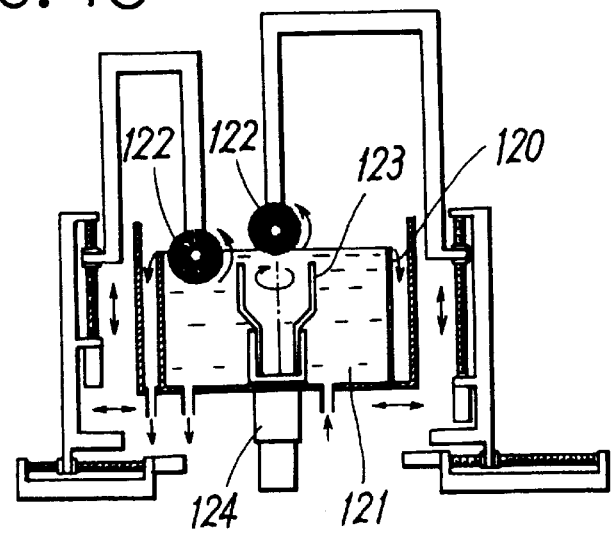
FIG. 16 PRIOR ART
FIG. 16 is a sectional view of a conventional washing apparatus.

The washing apparatus A includes a washing vessel 2 in the upper part of a machine body 1. The washing vessel 2 is installed so as to allow a washing liquid 3 such as pure water, a washing solution, or a chemical liquid to uniformly, continuously, and horizontally flow through liquid from a liquid supply section 4 side to a liquid ejection section 5 side, in order to wash the cassette body 111 shown in FIGS. 13 and 14. The washing vessel has a substantially horizontal-groove-shaped cross section.

A plurality of washing sections 6, 7, and 8 each shaped like a roll and individually washing different portions of the cassette body 111 are sequentially formed in the washing vessel 2 along the flow of the washing liquid 3.

Figure 3:
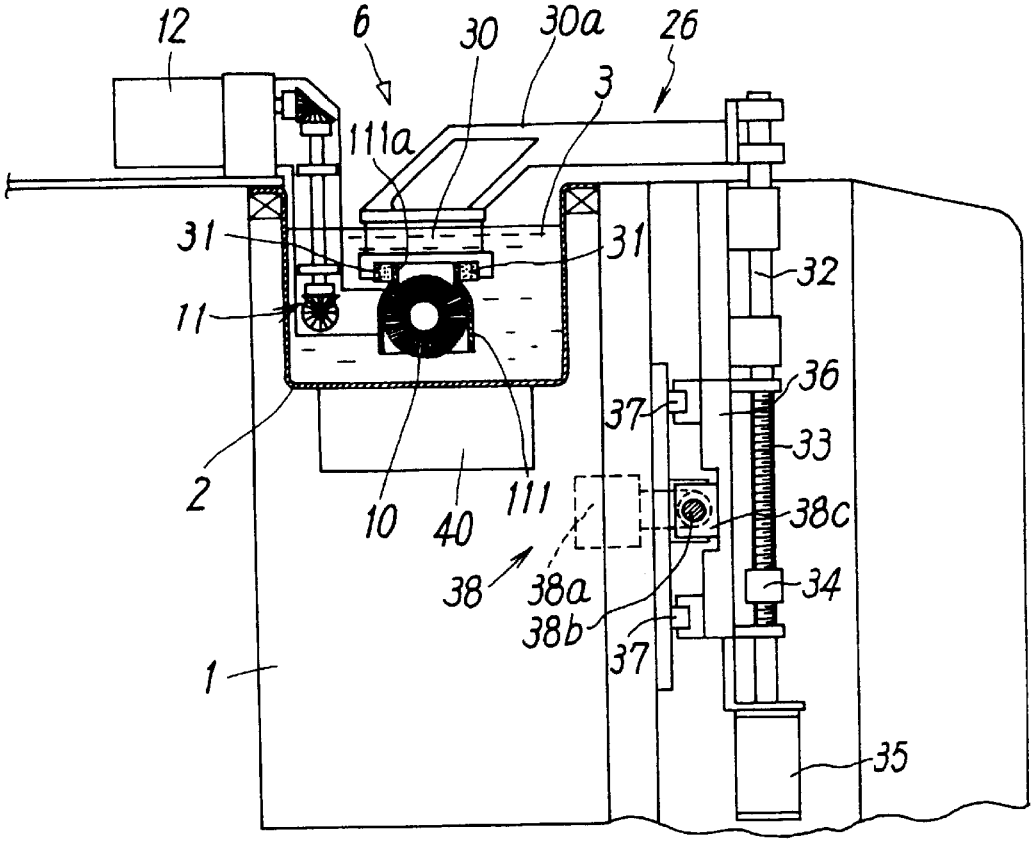
FIG. 3 is a sectional view taken along line III—III of FIG. 2.

As shown in FIG. 3, a first washing section 6 located on the downstream-most side possesses one washing brush 10 that is large enough to simultaneously wash both inner sides of the cassette body 111 having vertical grooves 115 (see FIG. 14) and that can be rotated at a specific position in the washing liquid 3 and around the horizontal axis parallel with the flow of the washing liquid 3; also, the washing brush 10 is connected to a motor 12 via a transmission mechanism 11.

In a second washing section 7 located on the upstream side of the washing section 6, two roll-like washing brushes 14, 14 that can rotate at a specified position in the washing liquid 3 and around the horizontal axis perpendicular to the flow of the washing liquid 3 are installed in parallel in the direction of the flow of the washing liquid, and at an interval that allows the brushes to simultaneously contact the front and rear surfaces, respectively, of the cassette body 111. The washing brushes 14, 14 are connected to individual motors 16 via transmission mechanisms 15 in such a way as to rotate in opposite directions. A flat brush 17 is fixedly installed between the washing brushes 14 and 14 to wash the inner surface of a narrower portion 111*a* (see FIG. 13) of the bottom of the cassette body 111. The flat brush 17 comprises a rectangular brush substrate 17*a* and fibers 17*b* set around the substrate in the horizontal direction.

Figure 4:
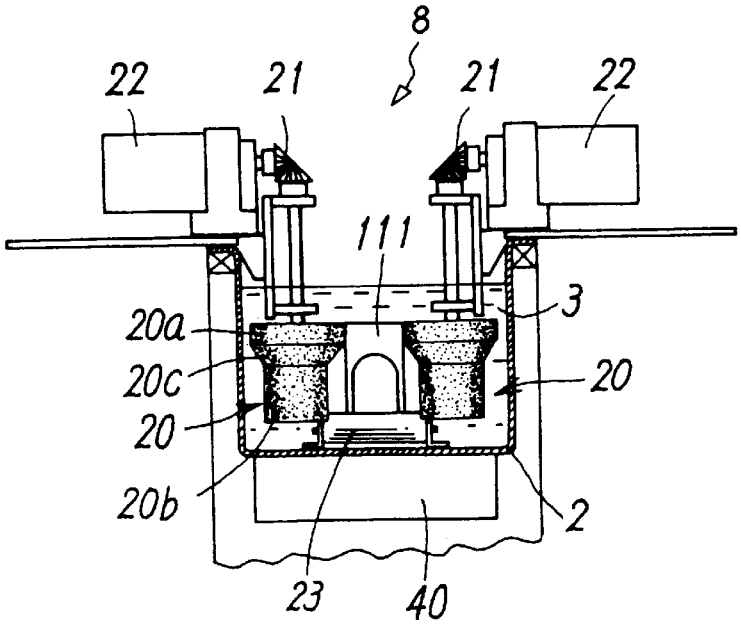
FIG. 4 is a sectional view taken along line IV—IV of FIG. 2.

Furthermore, as seen in FIG. 4, in a third washing section 8 located on the upstream-most side, two roll-like washing brushes 20, 20 that can rotate at a specified position in the washing liquid 3 and around the vertical axis are installed in parallel in the direction of the horizontal width of the washing vessel 2 at an interval that allows the brushes to simultaneously contact the right and left surfaces, respectively, of the cassette body 111. The washing brushes 20, 20 are connected to individual motors 22 via transmission mechanisms 21 in such a way as to rotate in the opposite directions so as to contact the cassette body 111 while rotating in a direction opposite to the moving direction of the body 111.

The washing brushes 10 and 14 provided in the first and second washing sections 6 and 7 are formed to have an equal diameter, but in the two washing brushes 20, 20 in the third washing section 8, an upper end portion 20*a* and a lower end portion 20*b* have different diameters and an inclined portion 20*c* is arranged between them in order to wash the inclined outer surface of the cassette body 111.

On the upstream and downstream sides of the washing brushes 20, 20 in the third washing section 8, a plurality of transfer rollers 23 for moving the cassette body 111 loaded thereon are installed in parallel on the bottom surface of the washing vessel 2. Each of the transfer rollers 23 rotates freely.

The washing apparatus also includes a loading means 25 for supplying the first washing section 6 with an unwashed cassette body 111 from a loader section 24; and a first, a second, and a third cassette transfer means 26, 27, and 28 disposed to correspond to the washing sections 6, 7, and 8. Each of the transfer means 26, 27, and 28 also acts as a support means for supporting the cassette body 111 being washed in the washing section 6, 7, or 8 while immersing it in the washing liquid. The third transfer means 28 corresponding to the third washing section 8 on the downstream-most side also acts as an unloading means for transferring to an unloading section 29 a cassette body 111 that has been washed.

The loading means 25 and the first and second transfer means 26 and 27 have substantially the same configuration. That is, as seen in FIGS. 1 and 3, the loading means and the transfer means 26 and 27 each have a chuck head 30 that can be moved freely in the axial direction of the washing vessel 2 and that can be elevated and lowered freely, and the check head 30 has four chuck members 31 chucking the four corners of the bottom of the cassette body 111 that has been turned upside down. The chuck member 31 consists of an air bag that is expanded and contracted by air supply and exhaust. The narrower portion 111*a* at the bottom of the cassette body 111 is placed between the chuck members 31 that have been contracted by exhaust, and air is then supplied to each chuck member 31 by an air supply source (not shown) to expand the chuck members, thereby allowing them to grip the narrower portion 111*a* from the exterior.

The chuck head 30 is mounted at the tip of a chuck arm 30*a* at the upper end of an elevating shaft 32, and the elevating shaft 32 is attached to a nut member 34 screwed on a ball screw 33 so as to move up and down when the motor 35 rotates the ball screw 33 to move the nut member 34 up and down. In addition, the ball screw 33 and the motor 35 are supported by a slide member 36 that is supported by slide rails 37 in the machine body 1 so as to move freely in the lateral direction and that can be moved by a drive mechanism 38 consisting of a motor 38*a*, a ball screw 38*b*, and a nut member 38*c*.

At the same time, the structure of the third transfer means 28 differs from those of the loading means 25 and the first and second transfer means 26 and 27 in that the chuck head 30 has two chuck members 31 formed of two air bags in the longitudinal direction and that the chuck member 31 chucks the narrower portion 111*a* of the cassette body 111 at two longitudinal points.

The loading means 25 and that transfer means 26, 27, and 28 simultaneously transfer the cassette body 111 with the same timing and are controlled so as to perform different operations during washing. During the washing of the cassette 111, the first and second transfer means 26 and 27, located in washing sections 6 and 7, respectively, oscillate slowly in the vertical direction either once or a plurality of times to press the chucked cassette body 111 against the washing brushes 10 and 14 in order to wash its inner, front, and rear surfaces. The third transfer means 28 moves the chucked cassette body 111 on the transfer roller 23 toward the upstream side to pass it between the opposed washing brushes 20, 20 in order to wash its outer side. At this point, the loading means 25 is standing by while chucking the cassette body located on the loader section 24 upside down.

Once the washing in each of the washing sections 6, 7, and 8 has been finished, the loading means 25 and each of the transfer means 26, 27, and 28 elevate while chucking the cassette body 111, move toward the upstream side over a distance corresponding to a single working area, and then lower to supply the chucked cassette body 111 to the adjacent working area. That is, the third transfer means 28 feeds the unloader section 29 with a cassette body 111 that has been completely washed, whereas the second transfer means 27 transfer to the third washing section 8, a cassette body 111 that has been subjected to washing of its front and rear surfaces, and then place the body 111 on the transfer roller 23. In addition, the first transfer means 26 transfers to the second washing section 7, a cassette body 111 that has been subjected to washing of its inner surface, and sets the body 111 between the two washing brushes 14, 14. The loading means 25 feeds an unwashed cassette body 111 to the first washing section 6 and places the body 111 on the washing brush 10 in such a manner as to cover the brush.

Once the transfer operation has been finished, the loading means 25 and each of the transfer means 26, 27, and 28 return to the loading section 24 and each of the washing sections 6, 7, and 8 to chuck the supplied cassette body 111 and then repeat the above washing and standby operations.

By allowing the plurality of washing sections 6, 7, and 8 to wash the respective portions of the cassette body 111 in this manner, the cassette body can be washed while being continuously transferred at the short intervals required to wash a single portion, thereby achieving very high washing efficiency and excellent throughput.

In addition, since the cassette body 111 is washed in the washing liquid 3 flowing in the horizontal direction, dirt released from the cassette body 111 is quickly and smoothly carried downstream by the flowing washing liquid 3 for ejection, thereby preventing the dirt from re-adhering to the cassette body 111 or the washing brushes.

In addition, the cassette body 111 is washed while being transferred from downstream to upstream, so when a washed cassette body 111 is unloaded from the washing vessel 2 at the upstream-most position, it has been rinsed due to its contact with the clean washing liquid 3.

Furthermore, the washing brushes 10, 14, and 20 in the washing sections 6, 7, and 8 are rotated at specified positions to move the frame-like cassette body, 111 the top and bottom surfaces of which are open, in a vertical direction or in a single horizontal direction, resulting in lower resistance from the washing liquid than that obtained with vertical oscillation of the washing brushes. This prevents any variation in the rotational speed of the brush, any decrease in washing efficiency caused by vertical vibration of brush's constituent fibers, and/or any hindrance to washing operations or dirt ejection caused by notable disturbance of the flow of the washing liquid 3, as occurs during oscillation of the washing brushes. As a result, the cassette body 111 can be washed very stably and efficiently.

A plurality of supersonic irradiation means 40 for irradiating the washing liquid 3 with supersonic waves are provided at the bottom of the washing vessel 2 in such a way as to correspond to the washing sections. Only one supersonic irradiation means 40 may be provided.

The liquid supply section 4 provided on one side of the washing vessel 2 is a closed chamber, and has at its boundary with the washing vessel 2, a straightening means 42 consisting of a fibrous plate of a non-woven cloth that has improved resistance to the flow of the washing liquid 3 due to its increased fiber density; and another porous plate so that pressure is applied to washing liquid 3 to push it toward the washing vessel 2 through the fibrous plate in order to provide an almost uniform flow velocity at all liquid depths. The straightening means 42 is desirably detachable.

At the same time, a porous plate 43 is provided in the liquid ejection section 5 so that the washing liquid 3 passes through the pores in the porous plate 43 with part of it overflowing the porous plate and flowing into the liquid ejection section 5. Desirably, the numerical aperture and distribution of the pores in the porous plate 43 can be changed by appropriate methods such as attachment and removal of plugs, in order to adjust the flow velocity and flow velocity distribution of the washing liquid.

A liquid supply mechanism 45 for recycling the washing liquid 3 is provided between the liquid supply section 4 and the liquid ejection section 5. The liquid supply mechanism 45 comprises a liquid supply tank 46 having a function of purifying the washing liquid; a pump 48 that force-feeds the washing liquid in the liquid supply tank 46 to the liquid supply section 4 through a pipe 47; and a filter 49 that filters the washing liquid 3 from the pump 48, wherein the washing liquid 3 ejected from the liquid ejection section 5 is collected in the liquid supply tank 46 through the pipe 47, where it is purified for reuse. New washing liquid, however, may be constantly supplied from a washing liquid source without adding the liquid supply mechanism 45.

In addition, according to the first embodiment, the washing brush 10 for washing the inner surface of the cassette body is disposed in the first washing section 6, the washing brush 14 for washing the front and rear surfaces of the cassette body and the flat brush 17 for washing the inner surface of the narrower-portion 111*a* are disposed in the second washing section 7, and the washing brush 20 for washing the outer surface of the cassette body is disposed in the third washing section 8. Any brush, however, can be freely provided in any washing section. For example, the washing brush 14 for washing the front and rear surfaces and the flat brush 17 may be disposed in the first washing section 6, while the washing brush 10 for washing the inner surface may be disposed in the second washing section 7.

Furthermore, by providing two sets of washing brushes in each of the washing sections 6, 7, and 8 in parallel and providing two sets of chuck mechanisms in each of the transfer means 26, 27, and 28 and loading means 25 in parallel, two cassette bodies can be simultaneously washed in parallel.

Figure 5:
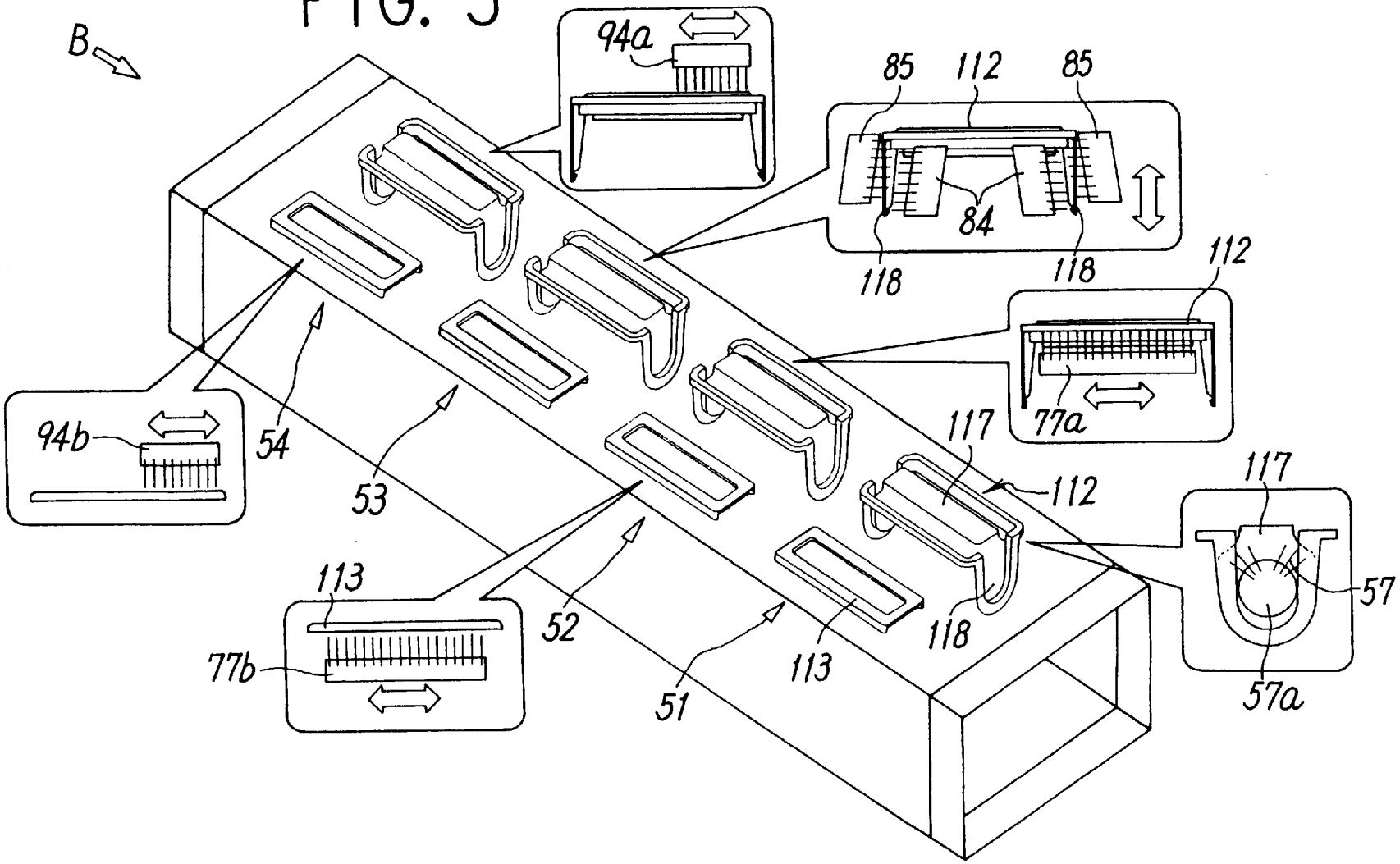
FIG. 5 is a perspective view conceptually showing a second embodiment of a washing apparatus according to this invention.

FIG. 5 is a conceptual drawing of a second embodiment of a washing apparatus according to this invention. A washing apparatus B is configured so that a top and a bottom covers 112 and 113 that are components of a cassette are simultaneously washed in parallel. The washing apparatus comprises a first to a fourth washing sections 51 to 54 in which different portions of the top and bottom covers 112 and 113 are sequentially washed using washing brushes. The washing apparatus B, according to the second embodiment, is described below in detail with reference to FIGS. 6 to 12.

Figure 6:
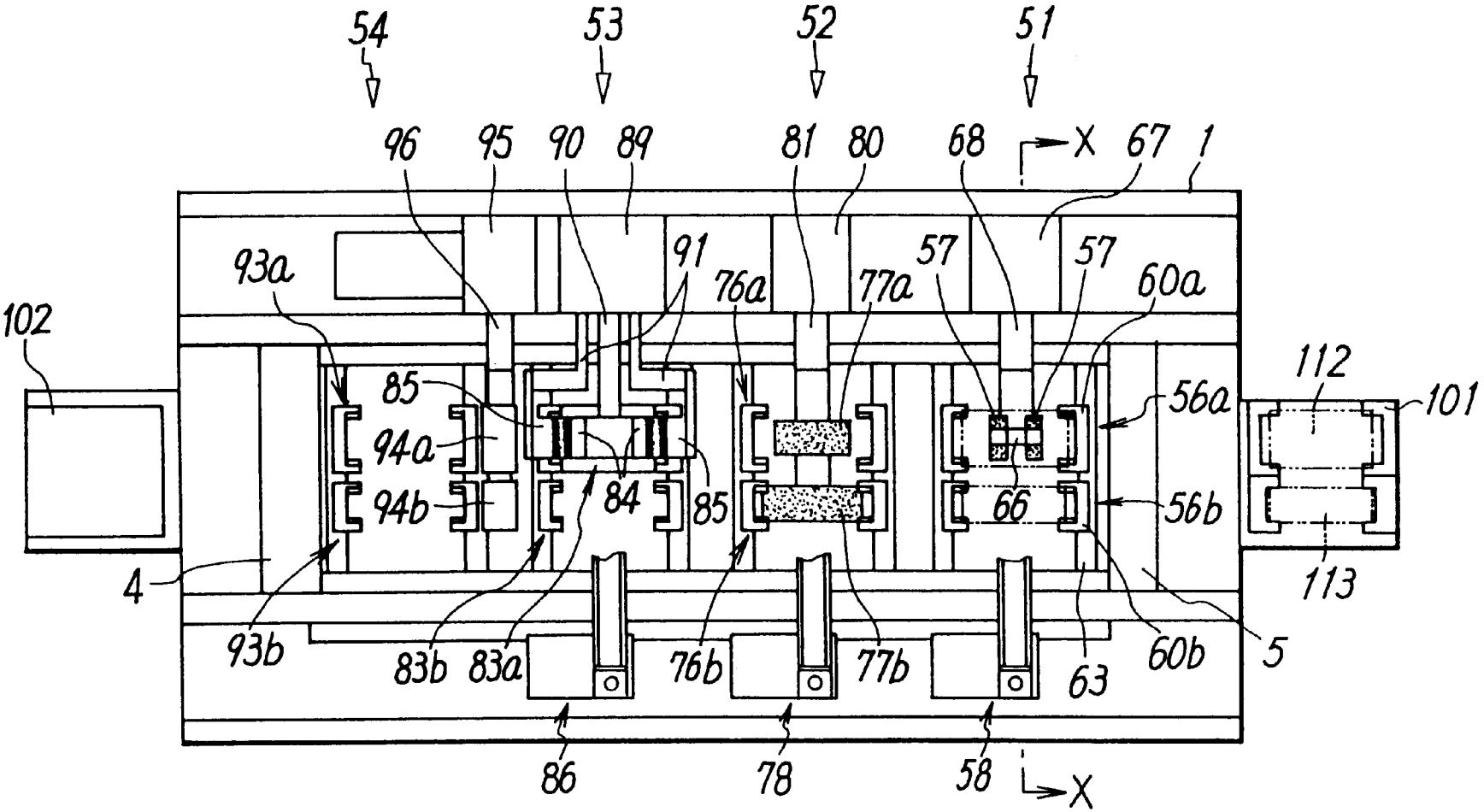
FIG. 6 is a top view of the integral part of the washing apparatus according to the second embodiment.
Figure 7:
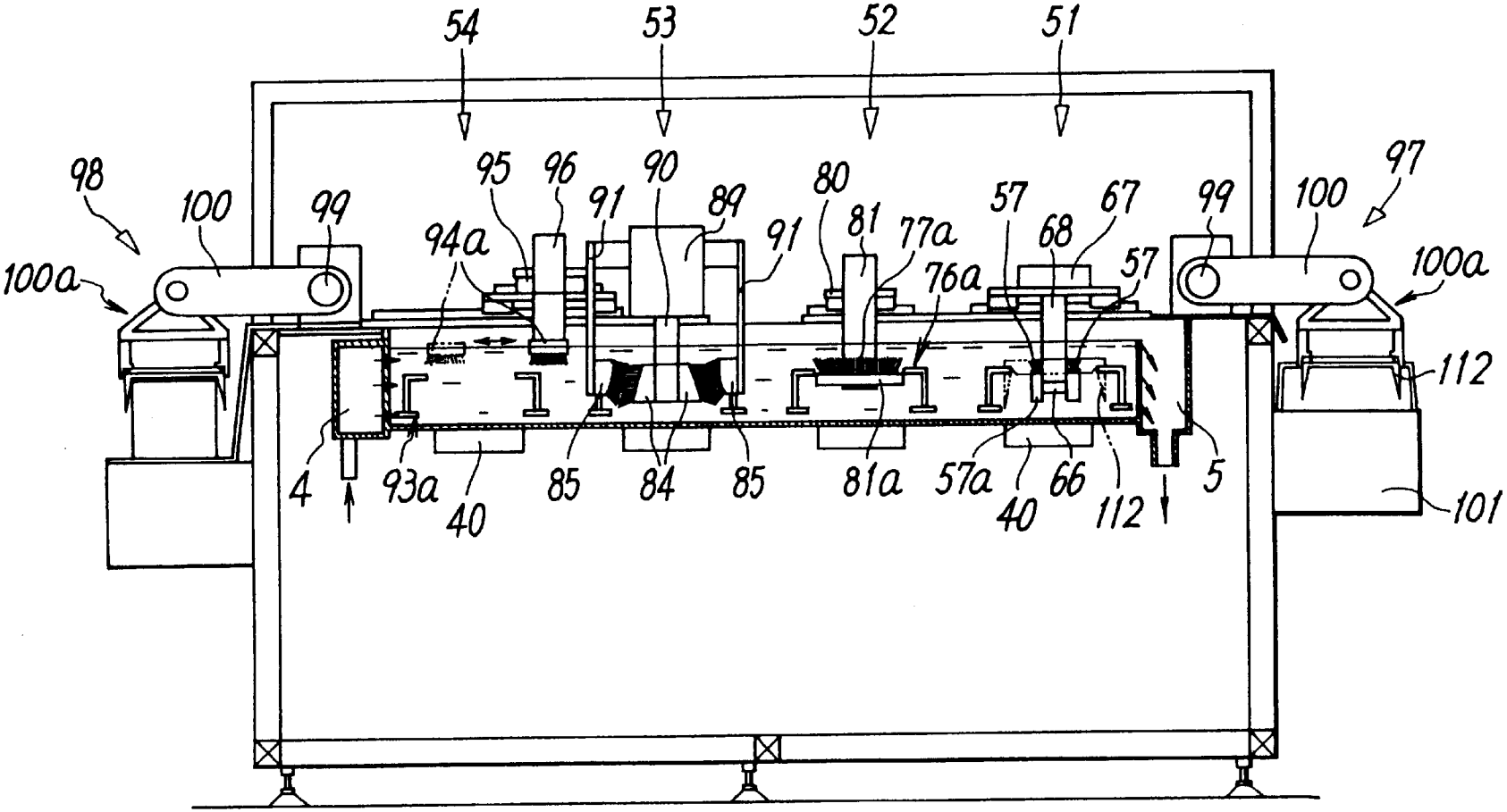
FIG. 7 is a side view of the washing apparatus according to the second embodiment.

As seen in FIG. 6 and 7, the first washing section 51 comprises support means 56*a* and 56*b* for supporting the top and bottom covers 112 and 113 in the positions shown in FIG. 5., a washing bush 57 for washing a grooved portion 117*a* in the inner surface of a roof portion 117 of the top cover 112 that is supported by the support means 56*a* and 56*b* (a workpiece inside 117 makes contact with 117*a*); and a first transfer means 58 for transferring the top and bottom covers 112 and 113 to the adjacent second washing section 52.

As seen in FIGS. 8A, 8B, 9A, and 9B, the support means 56*a* and 56*b* comprise pairs of support tables 60*a*, 60*a* and 60*b*, 60*b*, respectively, including support sections 60*c* that partly support the four corners of the top and bottom covers 112 and 113, respectively; and a plurality of hooks 61 that elastically chuck the top and bottom covers 112 and 113, respectively, where they do not obstruct washing.

Figure 8A:
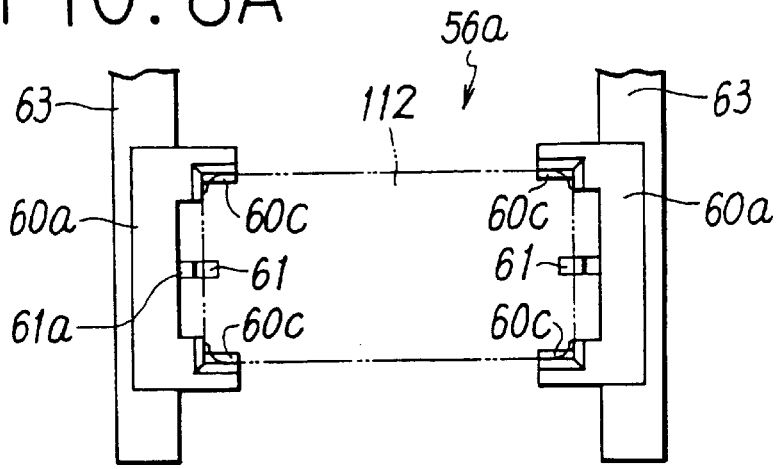
FIGS. 8A and B are a top view and a side view showing an example of a support means for a top cover.
Figure 8B:
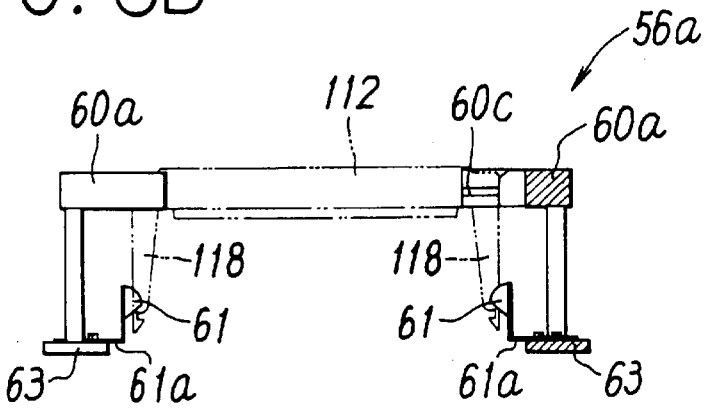
FIG. 8C is a top view showing another example of the top cover support means.
Figure 9A:
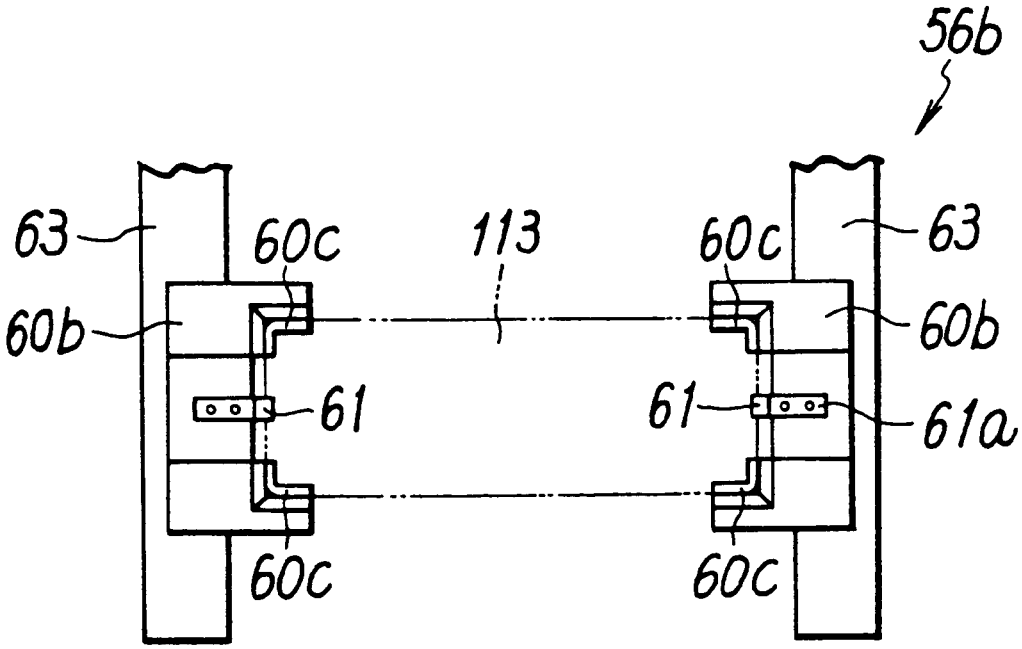
FIGS. 9A and B are a top view and a side view of the bottom cover support means.
Figure 9B:
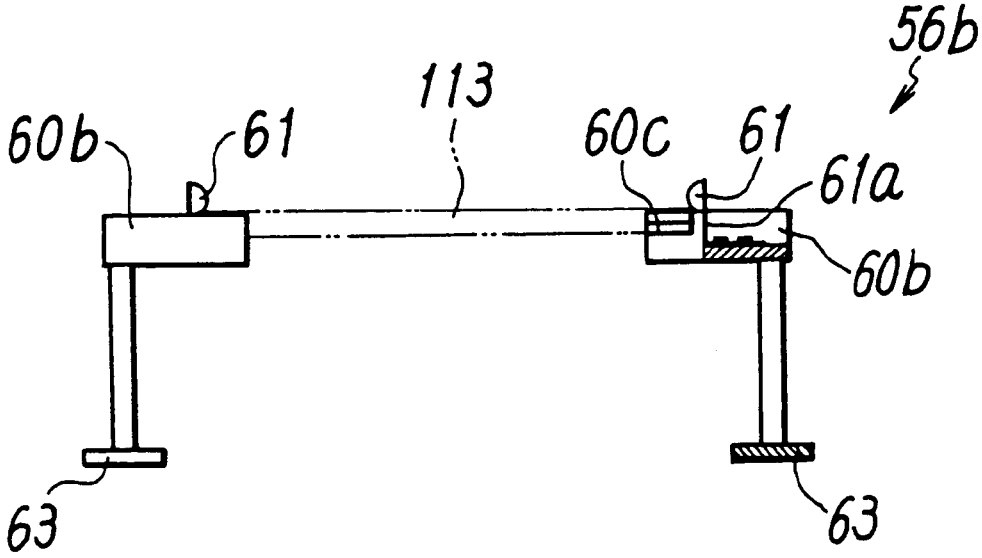

The support tables 60*a* and 60*b* are mounted in the washing vessel 2 using mounting plates 63. On support tables 60*a*, 60*a* on which the cover 112 is placed, springs 61*a* are mounted on the mounting plate 63, and the hook 61 is attached to the upper end of the spring 61*a* so as to engagingly lock into a rib on the outer surface of the lower end of a side plate portion 118 of the top cover 112, as shown in FIGS. 8A and 8B. On the support tables 60*b*, 60*b* on which the bottom cover 113 is placed, the springs 61*a* are provided at the center of the upper end of the table so as to be mutually opposed, and the hook 61 is attached to the upper end of the spring 61*a* so as to engagingly lock into the top surface of the bottom cover 113, as shown in FIGS. 9A and 9B.

Figure 10:
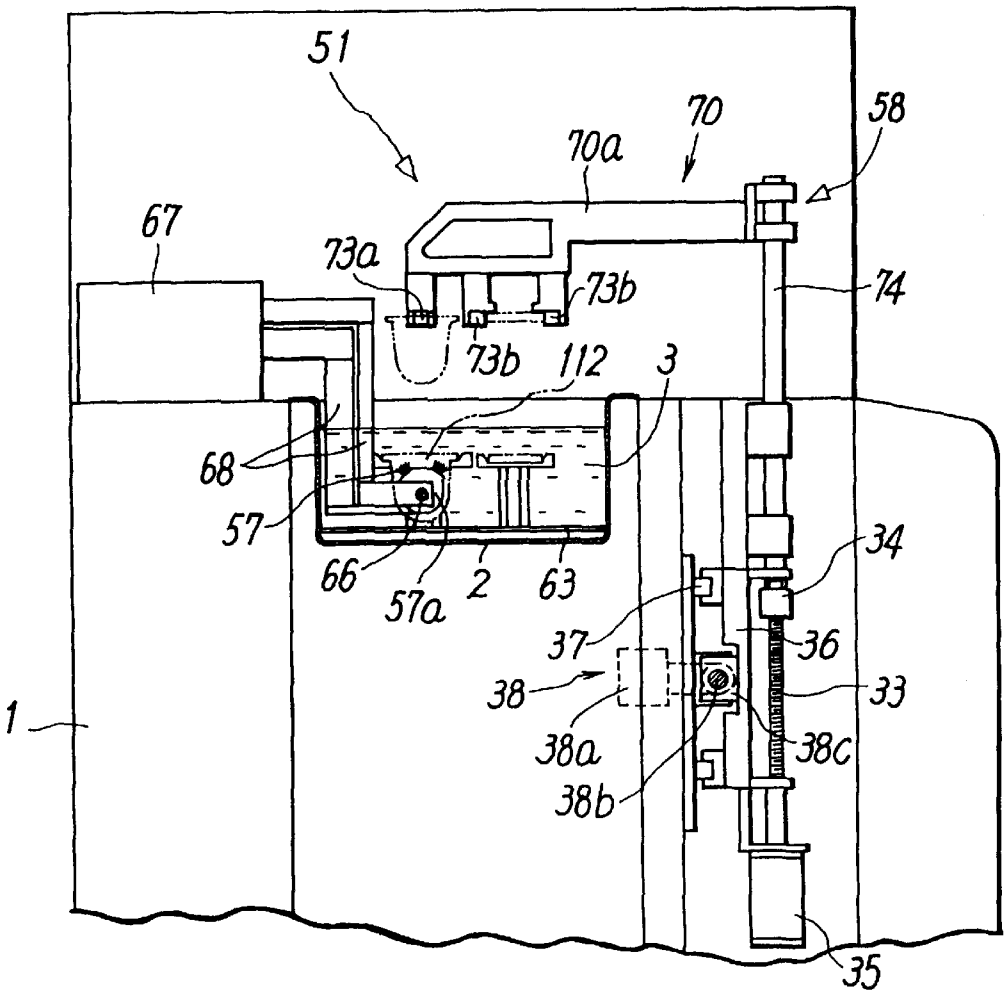
FIG. 10 is a sectional view taken along line X—X of FIG. 6.

In addition, as seen in FIG. 10, the washing brush 57 is provided on part of the top surface of a pair of disc-shaped brush holders 57*a*, 57*a* connected together by a connection shaft 66 in such a way as to connect a grooved portion 117*a* in the inner surface of the roof portion 117 of the top cover 112. The brush holder 57*a* is attached to the tip of a brush arm 68 extending from a drive mechanism 67 to the interior of the washing vessel 2 so as to be oscillated by the drive mechanism 67 through a specified angle around the connection shaft 66 at a low speed while also being moved by the mechanism 67 in the axial direction of the top cover 112 at a low speed.

Figure 11:
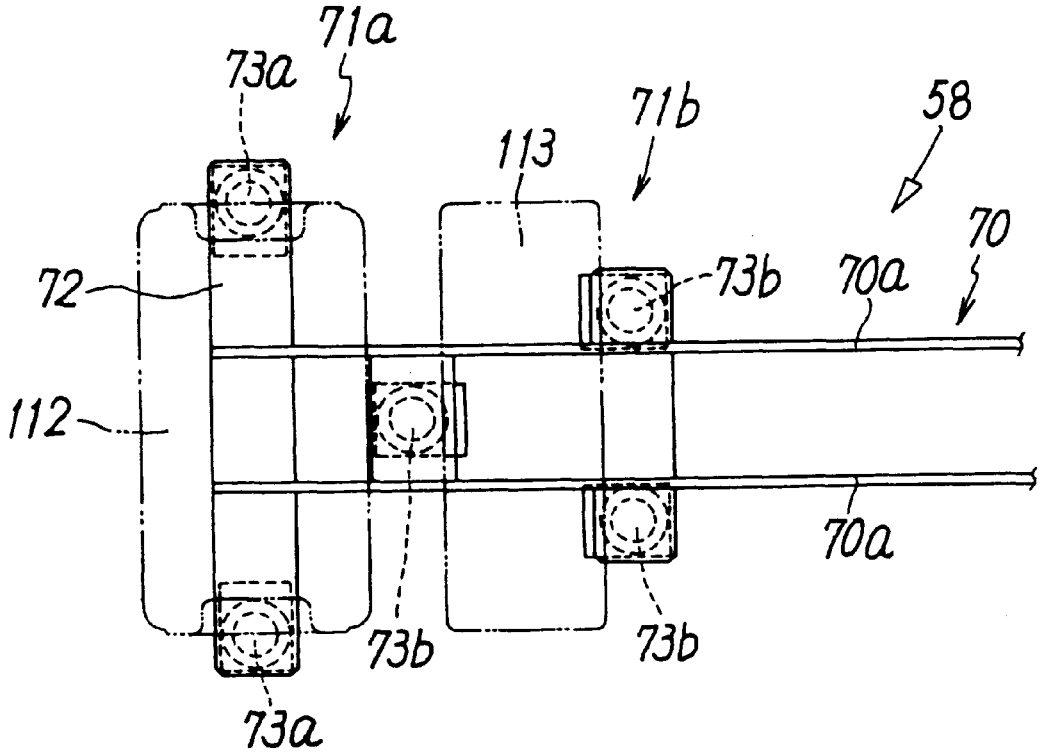
FIG. 11 is a top view showing an example of a chuck mechanism for washed objects included in a transfer means.

In the first transfer means 58, a chuck arm 70 consisting of a pair of plate-like members 70*a* extending along the width of washing vessel 2 possesses two sets of chuck mechanism 71*a* and 71*b* for chucking the top and bottom covers 112 and 113, respectively, as seen in FIGS. 10 and 11. The chuck mechanism is formed of a plurality of chuck members consisting of air bags, as in the transfer means 26 according to the first embodiment. That is, the chuck mechanism 71*a* for the top cover 112 possesses two chuck members 73*a* at the respective ends of the bottom surface of a plate 72 mounted at the tip of the chuck arm 70, and the chuck members 73*a* chuck the respective ends of the longitudinal top surface of the top cover 112. The chuck mechanism 71*b* for the bottom cover 113 possesses three chuck members 73*b* disposed at the respective sides of the bottom cover 113, and the chuck members 73*b* chuck the bottom cover 113 from the respective sides along the vessel's width.

As seen in FIG. 10, the chuck arm 70 is attached to the upper end of an elevating shaft 74 so as to be moved up, down, and horizontally by a drive mechanism 38 similar to the drive means 26 according to the first embodiment. The chuck arm 70 operates synchronously with a second and a third transfer means 78 and 86 to transfer an object that has been washed in the corresponding washing section, to the adjacent washing section upstream. Thus, the same components as in the first embodiment have the same reference numerals and their description is omitted.

As seen in FIGS. 6 and 7, the second washing section 52 includes support means 76*a* and 76*b* for supporting the top and bottom covers 112 and 113, respectively, in the positions shown in FIG. 5; a washing brush 77*a* for the top cover 112 that washes that portion other than the grooves in the inner surface of the roof portion 117 of the top cover 112 supported by the support means 76*a* and 76*b* which has not been washed by the first washing section 51; a washing brush 77*b* for the bottom cover 113 for washing the inner surface of the bottom cover 113; and a second transfer means 78 for transferring the top and bottom covers 112 and 113 to the adjacent third washing section 53.

The support means 76*a* and 76*b* have substantially the same configurations as the support means 56*a* and 56*b* provided in the first washing section 51.

The washing brushes 77*a* and 77*b* are provided on a bed plate 81*a* at the tip of a brush arm 81 extending from a drive mechanism 80 to the interior of the washing vessel 2, extend upward from the bed plate, and contact the portion other than the grooves in the inner surface of roof portion 117 of the top cover 112 and the overall inner surface of the bottom cover 113. The brushes are moved by the drive mechanism 80 via a brush arm 81 in the longitudinal direction of the top and bottom covers 112 and 113 at a low speed. This movement may be reciprocal.

Figure 12:
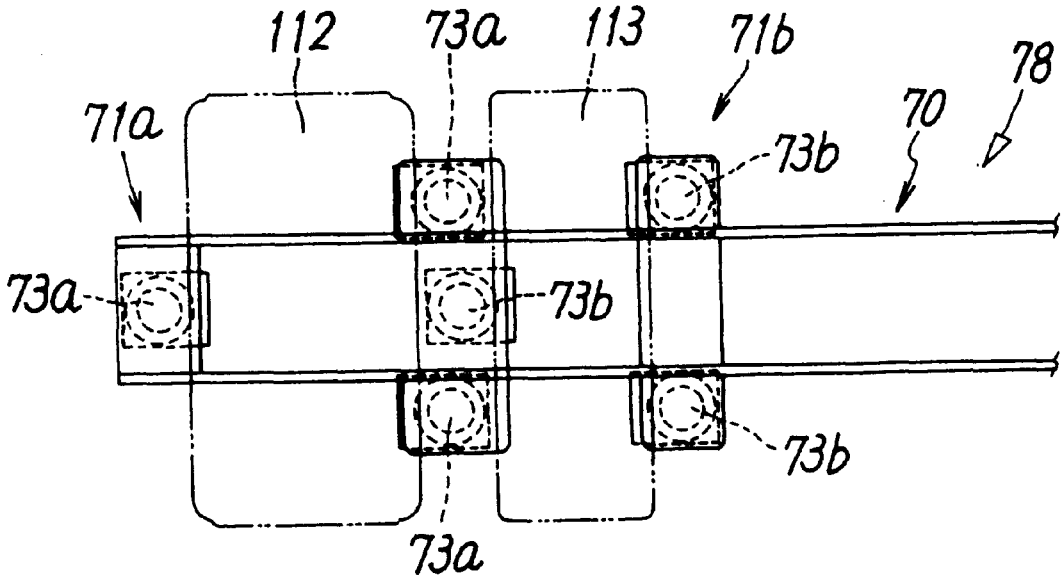
FIG. 12 is a top view showing another example of a chuck mechanism for washed objects included in the transfer means.

The second transfer means 78 basically has the same configuration as the first transfer means 58 except that the chuck mechanism 71*a* for the top cover 112 is slightly different from that in the first transfer means 58. That is, in the first transfer means 58, the two chuck members 73*a* chuck the top cover 112 from both longitudinal sides, whereas in the second transfer means 78 the three chuck members 73*a* shown in FIG. 12 are employed to the chuck the top cover 112 along its width. The other configuration of the second transfer means is substantially the same as that of the first transfer means 58.

Furthermore, as seen in FIGS. 6 and 7, the third washing section 53 includes support means 83*a* and 83*b* for supporting the top and bottom covers 112 and 113, respectively; two inner-surface brushes 84 that wash the inner surfaces of the pair of side plate portions 118, 118 of the top cover 112; two outer-surface brushes 85 that wash the outer surfaces of the side plate portions 118, 118; and a third transfer means 86 for transferring the top and bottom covers 112 and 113 to the adjacent fourth washing section 54.

Figure 8C:
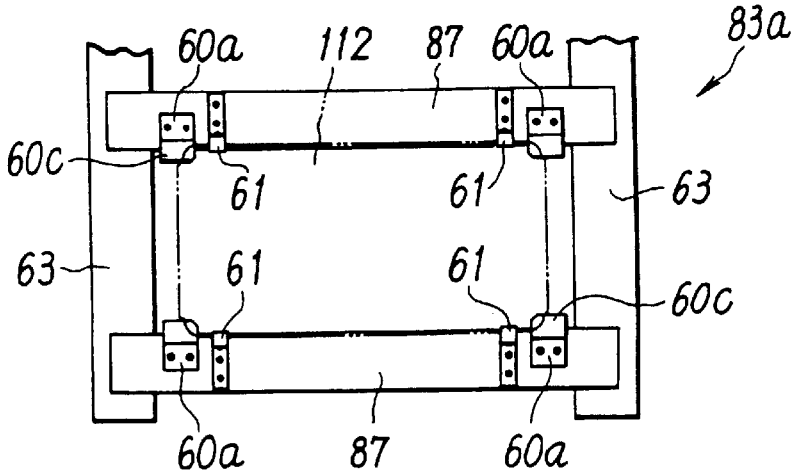

Of the above support means, the support means 83*b* for the bottom cover 113 is substantially the same as that provided in the first washing section 51, while the support means 83*a* for the top cover 112 differs from it in that the hooks 61 are provided where they do not obstruct the washing of the side plate portions 118. That is, as shown in FIG. 8C, four hooks 61 are provided on members 87, 87 passed between the right and left mounting plates 63, 63 to elastically and engagingly lock into the top surface of the top cover near its four respective corners. In this case, the support tables 60*a* are mounted on the members 87, 87.

The two inner brushes 84, 84 are provided at the tips of a brush arm 90 extending from a drive mechanism 89 to the interior of the washing vessel 2, and extend outward from the tip of the brush arm, and move up and down along the inner surface of the side plate portion 118 at low speed. At the same time, the two outer-surface brushes 85, 85 are provided at the tips of brush arms 91, 91 extending from the drive mechanism 89 to the interior of the washing vessel 2 and extend inward from the tip of the brush arm, and move up and down along the side plate portion 118 in such a way that the interval between the brushes can be increased when the top cover is supplied or removed.

The third transfer means 86 has the same configuration as the second transfer means 78, so its description is omitted.

Furthermore, as seen in FIGS. 6 and 7, the fourth washing section 54 includes support means 93*a* and 93*b* for supporting the top and bottom covers 112 and 113, respectively; and two sets of washing brushes 94*a* and 94*b* for washing the top surfaces of the top and bottom plates 112 and 113, respectively, supported by the support means 93*a* and 93*b*.

Of the support means 93*a* and 93*b*, the support means 93*a* for the top cover 112 is substantially the same as the support means 56*a* provided in the first washing section 51, whereas the support means 93*b* for the bottom plate 113 differs from the support means 56*b* in the first washing section 51 in that the hooks 61 are disposed in such a way as to elastically and engagingly lock into the top surface of the bottom cover 113 near its four corners, so as not to obstruct the washing of the side plate portion.

The washing brush 94*a* for the top cover 112 and the washing brush 94*b* for the bottom cover 113 are provided at the tip of a brush arm 96 extending from a drive mechanism 95 to the interior of the washing vessel 2, extend downward from the tip of the brush arm, and during washing, move in the longitudinal direction of the top and bottom covers 112 and 113. While washing is not in progress, the washing brushes 94*a* and 94*b* are located between the third and fourth washing sections 53 and 54 as shown in FIGS. 6 and 7, so that when the top and bottom covers 112 and 113 are fed from the third washing section 53 to the fourth washing section 54, the washing brushes 94*a* and 94*b* move to above the top and bottom covers 112 and 113 for washing.

In addition, the loading and unloading means 97 and 98 each have a chuck head 100*a* for chucking the top and bottom covers 112 and 113, located at the tip of an arm 100 that can rotate around a supporting shaft 99. The chuck head 100*a* includes two sets of chuck mechanisms having a configuration similar to that of the first transfer means 58 in the first washing section 51.

According to the second embodiment, the first to third transfer means 58, 78, and 86 and the loading and unloading means 97 and 98 operate synchronously with the same timing, and simultaneously perform the operations of supplying the top and bottom covers 112 and 113 from the loading section 101 to the first washing section 51, transferring the top and bottom covers 112 and 113 from the first, second, and third washing sections 51, 52, and 53 to the second, third, and fourth washing sections 52, 53, and 54, respectively, and transferring the top and bottom covers 112 and 113 from the fourth washing section 54 to the unloading section 102.

In the second embodiment, any portions of the top and bottom covers 112 and 113 may be washed in any of the first to fourth washing sections; the above washing order need not be used.

In addition, although the second embodiment shows a configuration that provides for simultaneous washing of the top and bottom covers 112 and 113, only one of the covers 112 and 113 may be washed as well, by removing the mechanism associated with the other. Alternatively, a plurality of the same mechanisms can be provided in order to simultaneously wash a plurality of top or bottom plates 112 or 113.

Furthermore, although the above embodiments each allow the washing liquid to flow along the longitudinal axis of the groove-shaped washing vessel and to dispose a plurality of washing sections along the flow of the washing liquid, the washing liquid may be allowed to flow along the washing vessel's short-side (i.e, horizontal) axis by providing liquid supply and ejection sections on the respective short sides while leaving the arrangement of each washing section unchanged. In this case, the washed object is washed while being transferred across the flow of the washing liquid, thereby preventing dirt from the preceding washing section from adhering to the washed object. Further in this case, the directions of each washing brush and washed object are desirably set so as to minimize resistance to the flow of the washing liquid.

Thus, by using a plurality of washing sections to wash multiple portions of the cassette, this invention can wash the cassette while continuously transferring it during the short intervals required to wash a single portion, thereby achieving very high washing efficiency and excellent throughput.

In addition, since the cassette is washed in washing liquid flowing in a horizontal direction, dirt of smaller specific gravity released from the cassette is carried quickly and smoothly by the flowing washing liquid to the downstream side for ejection, whereas dirt of larger gravity precipitates quickly to the bottom of the vessel where it does not obstruct washing or re-adhere to the cassette or the washing brushes.

In addition, the cassette is washed while being transferred from downstream to upstream, so once the cassette that has been washed is unloaded from the washing vessel at its upstream-most position, it has been rinsed due to its contact with the clean washing liquid.

What is claimed is:

1. An apparatus for washing a three-dimensional part constituting a cassette in which a plurality of disc-shaped workpieces are accommodated in a vertical direction;

a groove-shaped washing vessel through which a washing liquid uniformly, continuously, and horizontally flows substantially at all liquid depths from one direction to the other direction;

a plurality of washing sections formed along said washing vessel for individually washing different portions of an object to be washed in the washing liquid, each washing section using washing brushes;

a support means provided in each of said washing sections for supporting in the washing liquid the object being washed;

a plurality of transfer means operating synchronously to chuck the object that has been washed in each washing section in order to transfer it to the adjacent washing section;

a loading means for supplying an unwashed object to the downstream-most washing section; and an unloading means for unloading the washed object from the upstream-most washing section.

2. A washing apparatus according to claim 1 wherein a plurality of sets of washing brushes for washing a plurality of objects are provided in at least one of the plurality of washing sections, and wherein each support means, each transfer means, the loading means, and the unloading means are each configured to hold a plurality of washed objects to enable these objects to be simultaneously processed in parallel.

3. A washing apparatus according to claim 1 wherein the washing apparatus has three washing sections for washing a rectangular-frame-like cassette body in which its top and bottom surfaces and longitudinal sides are open and which has a narrower lower end, wherein:

one roll-like washing brush that can wash the inner surface of said cassette body at one time is provided so as to rotate at a specified position in the washing liquid, wherein:

two roll-like washing brushes that can rotate at specified positions in the washing liquid are installed in another washing section in parallel at an interval that allows the brushes to contact the front and rear surfaces of the cassette body at the same time, and wherein:

two roll-like washing brushes that can rotate at specified positions in the washing liquid are installed in yet another washing section in parallel at an interval that allows the bushes to contact both the right and left sides of the cassette body.

4. A washing apparatus according to claim 3 wherein each of said transfer means for transferring the cassette body to the upstream washing section also acts as a support means for supporting the cassette body being washed, and wherein the transfer means provided so as to correspond to the washing section for washing the inner surface of the cassette body and the transfer means provided so as to correspond to the washing section for washing the front and rear surfaces of the cassette body are each configured so as to oscillate in the vertical direction during washing while also chucking the cassette body.

5. A washing apparatus according to claim 4 wherein the washing apparatus possesses three transfer means and one loading means and wherein the transfer means located on the upstream-most side also acts as an unloading means.

6. A washing apparatus according to claim 3 wherein a flat washing brush for washing the inner surface of the narrower lower end of the cassette body is provided between the two washing brushes installed in the washing section for washing the front and rear surfaces of the cassette body.

7. A washing apparatus according to claim 1 having four washing sections for washing a top cover including a roof portion that covers the open top surface of the cassette body and a pair of side plate portions that cover the sides of the cassette body, wherein:

a washing brush for washing a grooved portion in the inner surface of the roof portion of said top cover that workpieces are contacted with is provided in one of the four washing sections so as to move freely along said grooves in the washing liquid, wherein:

a washing brush for washing the portion of the inner surface of the roof portion of said top cover that is other than said grooves is provided in another washing section so as to move freely along said portion to be washed in the washing liquid, wherein:

two inner-surface brushes for washing the inner surfaces of the pair of side plate portions of said top cover and two outer-surface brushes for washing the outer surfaces of the side plate portions are each provided in yet another washing section so as to move freely along said side plate portion in the washing liquid, and wherein a washing brush for washing the outer surface of the roof portion of said top cover is provided in the remaining washing section so as to move freely along the outer surface of said roof portion in the washing liquid.

8. A washing apparatus according to claim 7 having three transfer means, one loading means, and one unloading means, these means operating synchronously to transfer workpieces.

9. A washing apparatus according to claim 7 configured to simultaneously wash a shallow-dish-like bottom cover covering the open bottom surface of the cassette body, wherein:

in two of said four washing sections, a washing brush for washing the outer or inner surface of said bottom cover is provided adjacent to the washing brush for washing said top cover, and wherein:

each of said support means and transfer means, the loading means, and the unloading means are configured to hold said top and bottom covers simultaneously.

10. A washing apparatus according to claim 1, wherein said washing vessel possesses one or more supersonic irradiation means for irradiating the washing liquid with supersonic waves.

* * * * *

UNITED STATES PATENT AND TRADEMARK OFFICE

CERTIFICATE OF CORRECTION

PATENT NO. : 6,052,855

DATED : April 25, 2000

INVENTOR(S) : Yoshinobu Terui

It is certified that error appears in the above-identified patent and that said Letters Patent is hereby corrected as shown below:

On the Title Page, Item [73] the Assignee should read as follows:

[73] Assignee: Speedfam Clean System Co., Ltd.,
Ayase, Japan

Signed and Sealed this

Tenth Day of April, 2001

*Attest:*

Nicholas P. Godici

NICHOLAS P. GODICI

*Attesting Officer*

*Acting Director of the United States Patent and Trademark Office*